US005081947A

United States Patent [19]

Holden

[11] Patent Number: 5,081,947

[45] Date of Patent: Jan. 21, 1992

[54] BOAT ASSEMBLY

[76] Inventor: Wesley G. Holden, 4550 Roswell Rd., Q3, Atlanta, Ga. 30342

[21] Appl. No.: 538,731

[22] Filed: Jun. 15, 1990

[51] Int. Cl.[5] ..... B63B 7/06

[52] U.S. Cl. ..... 114/345; 114/352; 440/31

[58] Field of Search ..... 114/345, 346, 352, 351, 114/140, 294; 441/129, 130; 440/26, 29-31

[56] References Cited

U.S. PATENT DOCUMENTS 2,319,132 5/1943 Hood ..... 440/31 X
2,747,204 5/1956 Erickson et al. ..... 114/351
2,794,992 6/1957 Metzing ..... 114/352
3,659,544 5/1972 Goepfrich ..... 114/294

*Primary Examiner*—Sherman Basinger

[57] ABSTRACT

A portable boat assembly for use by an operator having a stern module, a bow module integrable with the stern module, an inflatable tube which surrounds the bow and stern modules and forms the float platform of the boat, a propeller assembly disposed beneath the bow and stern modules, a pedal and gear assembly disposed in the bow module such that movement of the pedal and gear assembly is converted into movement of the propeller assembly for propelling the boat through water, a rudder and tiller assembly attachable to the rear of the stern module for directing the boat through the water, and keels for controlling the drift and set of the boat.

10 Claims, 7 Drawing Sheets

BOAT ASSEMBLY

BACKGROUND OF THE INVENTION

The present invention relates to a small and affordable boat, and more particularly to a portable, lightweight, easy-to-operate fishing and recreational boat or rescue vehicle.

Fishing and recreational boats tend to be large, heavy and expensive. Most of these boats are difficult or impossible to operate in shallow waters where many fish inhabit. Many of these boats are operated with motors, making them noisy and scaring away fish. In addition, these motorboats are somewhat dangerous to operate, especially for children.

Some smaller boats have been produced using rigid or inflatable construction designs. Of these small boats, generally the inflatable boats are powered by oars, while the rigid boats use motors. These small boats tend to be heavy, making them difficult to transport, and they are relatively expensive. All of these known boats require either considerable dexterity to operate, at least two strong people to load them, or both. Operating these boats usually requires use of one or both of the operator's hands, making it difficult for the operator to simultaneously maneuver the boat and have the operator's hands free for using fishing gear. In addition, none of these boats, except the inflatables, can be transported inside an automobile or easily stored in a closet or other small enclosure.

SUMMARY OF THE PRESENT INVENTION

The present invention provides a portable, very stable, easy-to-operate, and affordable boat. The invention includes two modules, which integrate to form an elliptical watertight base. The elliptical base fits securely inside a radial, inflatable tube, such that the boat formed is watertight. The boat includes pedals, a gear box, drive train and a propeller for moving the boat forward or backward in the water. A rudder assembly is used to maneuver the boat. One module fits inside the other module for portability when transporting and convenient storage.

The present invention can be operated in shallow water. It is easy to assemble and to operate. It is lightweight, making it easy to transport in an automobile trunk, and it is stable and safe to use. In addition, the pedal assembly of the present invention allows this boat to be operated primarily with one's feet. The propeller assembly used in the present invention is used in place of a motor, and allows for quiet operation in order to not scare away fish.

The object of this invention is to provide a boat which is portable, lightweight, and easy to transport.

Another object of this invention is to provide a boat which is safe to operate and affordable.

Another object of this invention is to provide a boat which is operable in shallow water.

Another object of this invention is to provide a boat that can be operated almost solely with one's feet.

A further object of this invention is to provide a boat having easy maneuverability and which allows for quiet operation.

DETAILED DESCRIPTION OF THE PREFERRED EMBODIMENT

Figure 1:
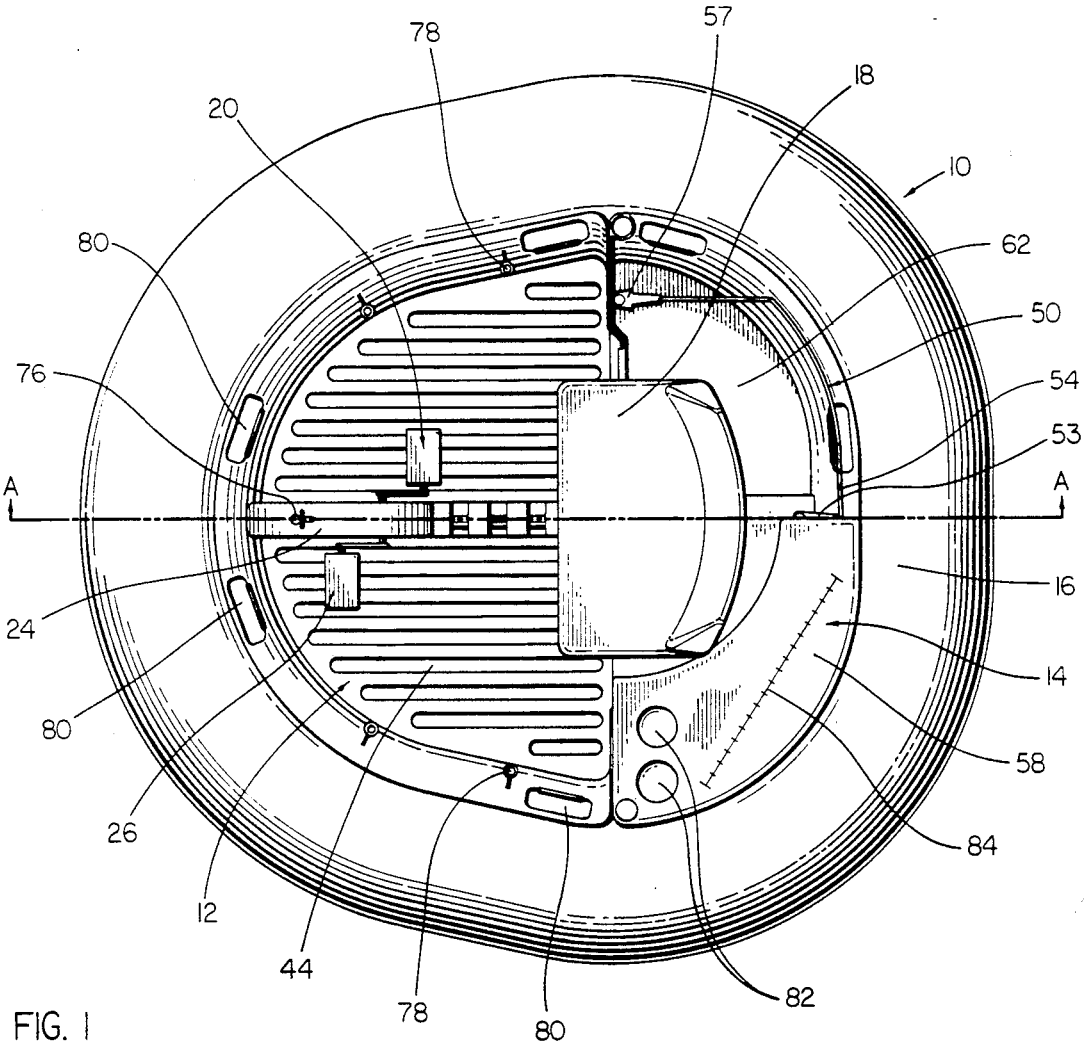
FIG. 1 shows a top view of an embodiment of the present invention.
Figure 2:
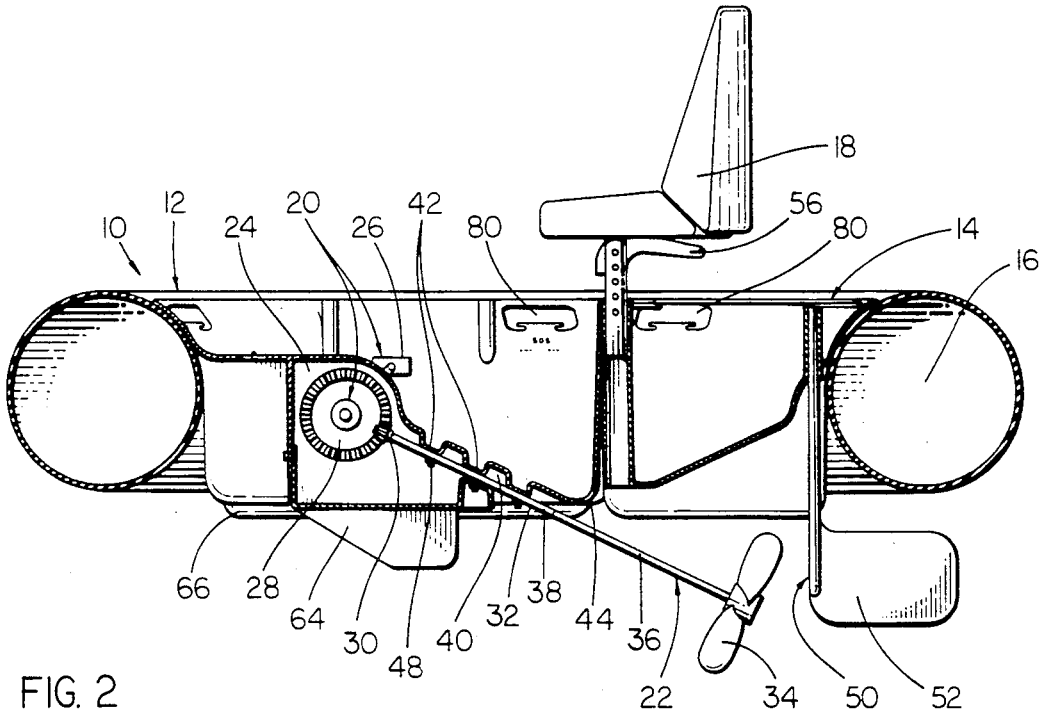
FIG. 2 shows a cross-sectional view of the present invention as taken along line A—A shown in FIG. 1.

As shown in FIGS. 1 and 2, the present invention includes a bow module 12, a stern module 14 and an inflatable tube 16 surrounding the bow and stern modules 12 and 14. The modules 12 and 14 are semielliptical in shape, having a rounded side and a flat side. When assembled, the flat sides of each module are interlocked thereby forming a float platform. Wing nuts and screws are used to fasten and align the modules together. An inflatable tube 16 surrounds the boat 10 to provide buoyancy and to secure the modules together, making the boat 10 watertight. In use, the operator of the boat 10 will sit at the forward portion of the stern module 14. A seat 18 can be positioned in the forward portion of the stern module 14 for more comfortable use by the operator. Preferably, a swivel seat is used for ease of movement by the operator. In addition, preferably the seat has a vertical adjustment to allow for optimal leverage for each individual operator.

Preferably, the bow and stern modules 12 and 14 are, approximately fourteen inches deep, while the tube 16, when inflated, is approximately thirteen inches deep. The inflated tube 16 surrounds the entire circumference of the modules 12 and 14 such that the top of the tube 16 is flush with the top of the interlocked modules 12 and 14, and the bottom of the tube 16 is about one inch above the bottom of the modules 12 and 14. When the tube 16 is inflated, the inside diameter of the tube 16 decreases, thereby securing the modules 12 and 14 together. This design allows for an operator to sit on the seat 18 of the stern module 14 or to simply sit directly on the stern module 14, while preventing the expulsion of the modules 12 and 14 from the tube 16.

Preferably, the modules 12 and 14 are made of polypropylene to increase longevity of the boat 10, and have a wall thickness of approximately 3/16". Polypropylene is less dense than water, thus making the modules 12 and 14 unsinkable. The modules 12 and 14 are produced to have about a 1° draft on all outside surfaces. This 1° draft allows for physical stress compensation and enables the modules 12 and 14 to be easily released from their molds during manufacturing. Thus, the modules 12 and 14 are mass producible at low costs.

In addition, the modules 12 and 14 may include a flange lip of approximately 3 inches around the perimeter of the modules 12 and 14. This flange lip unites the modules 12 and 14 with the tube 16 to form a watertight seal, prevent the modules 12 and 14 from pushing through the tube 16, and prevent wear on the tube 16 along the gunwale of the boat 10.

The bow module 12 includes a pedal and gear assembly 20, which is integrated with a propeller assembly 22, to provide means for moving the boat 10 through water. The gear box 24 is designed to provide watertight integrity and to allow the transfer of foot power from the pedals 26 to the propeller assembly 22, having equal thrust in the forward or reverse directions. The pedal and gear assembly 20 includes bevel gears, whereby a large gear 28, rotated by the pedals 26, is integrable with a small gear 30 attached, preferably molded, to a shaft 32 of the propeller assembly 22 such that the gears 28 and 30 are aligned at approximately a 90° angle. Preferably, the gears 28 and 30 have a ratio such that one turn of the pedals 26 will cause multiple turns of the propeller 34 of propeller assembly 22.

In this invention, in order to make the pedal and gear assembly 20 as corrosion-free and rust-free as possible, the assembly 20 is preferably made of polycarbonate structural foam. The pedal and gear assembly 20 is disposed in a recessed cavity or gear box 24 inside the center of the bow module 12.

The propeller assembly 22 includes a two-piece shaft 32 and a propeller 34. The two-piece shaft 32 has a lower portion 36 and an upper portion 38. The lower portion 36 of the shaft 32 includes a narrow end having a locking snap-pin and the upper portion 38 includes a through hole. The upper and lower portions 36 and 38 are attached by inserting the narrow end of the lower portion 36 inside the upper portion 38 such that the locking snap-pin is inserted into the through hole. The propeller 34 is molded onto the end of the lower portion 36 of the shaft 32. Preferably, the propeller 34 is a 3-bladed propeller and is made of polypropylene, while the shaft 32 is aluminum. The propeller also may include an outside housing to prevent weed entanglement and injury to swimmers.

The propeller assembly 22 is permanently secured in place through shaft cavity 40. The shaft cavity is formed by a series of three small recesses 42 in the floor 44 of bow module 12, which forms part of gear box 24. Gear box 24 maintains a splash-free housing for gears 28 and 30. The upper portion 38 of the propeller shaft 32 is inserted into the shaft cavity 40 and is secured in place with propeller shaft supports 48. Preferably, devices such as clips, are used as propeller shaft supports 48. The propeller shaft 32 is positioned in the shaft cavity 40 with securing means, such as a pressed-in teflon bushing, so that it can rotate freely in response to the movement of the pedal and gear assembly 20.

Figure 4:
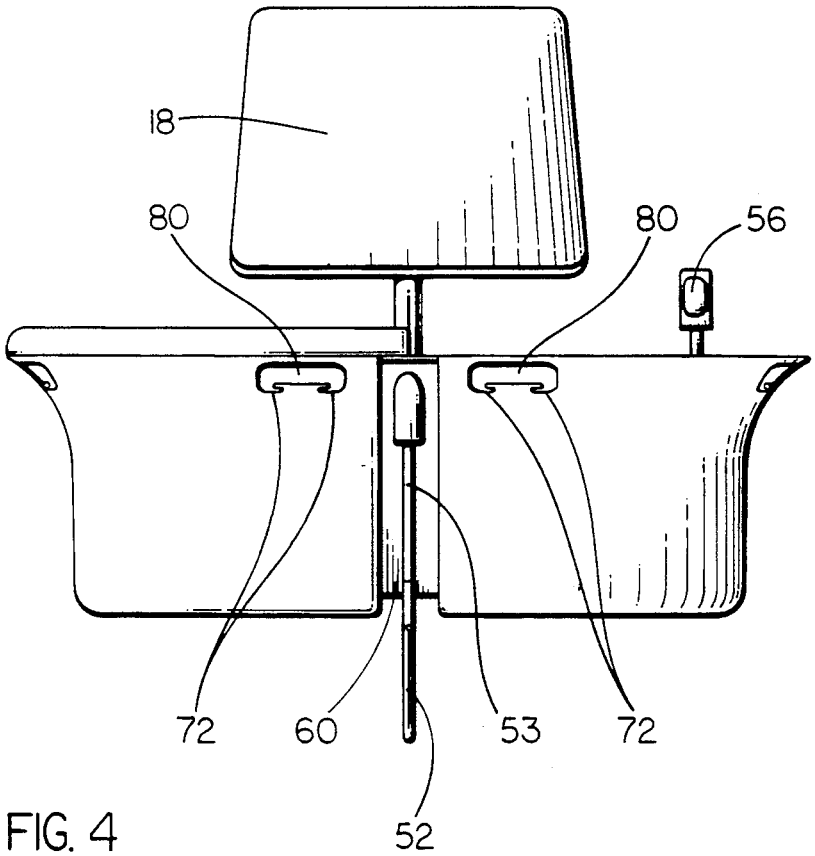
FIG. 4 shows a partial rear view of the present invention.

A rudder and tiller assembly 50 is used to steer the boat 10. The assembly 50 includes a rudder 52, a rudder linkage 54, and a tiller 56. The tiller 56 is located along the forward portion of stern module 14 and protrudes upward at one side of the operator's seat 18, such that the tiller 56 is accessible to the operator. The tiller 56 may be positioned 360 for the operator's convenience. The tiller 56 fits into a tiller bellcrank 57 such that the bellcrank 57 limits the rudder 52 movement. In other words, the tiller 56 can only rotate a limited number of degrees left or right such that the corresponding rudder 52 movement is limited. Preferably the rudder 52 movement is limited to 160°, that is 80° to starboard and 80° to port. The tiller 56 is attached to a rudder linkage 54, which is preferably a piece of angled stainless steel wire. The linkage 54 is connected with alignment notches to a rudder bellcrank 53, which is connected to the rudder 52 shown in FIG. 2. As shown in FIG. 4, the rudder 52 fits inside a recessed slot 60 which extends through the middle of the stern module 14. The rudder 52 is disposed such that its movement left and right is not obstructed by the stern module 14. The rudder and tiller assembly 50 is designed to provide permanent reciprocal linkage between the rudder 52 and the tiller 56. The linkage 54 is designed along the contour of the stern module 14 in order to avoid interference with the storage space 62 located inside the stern module 14.

Figure 3:
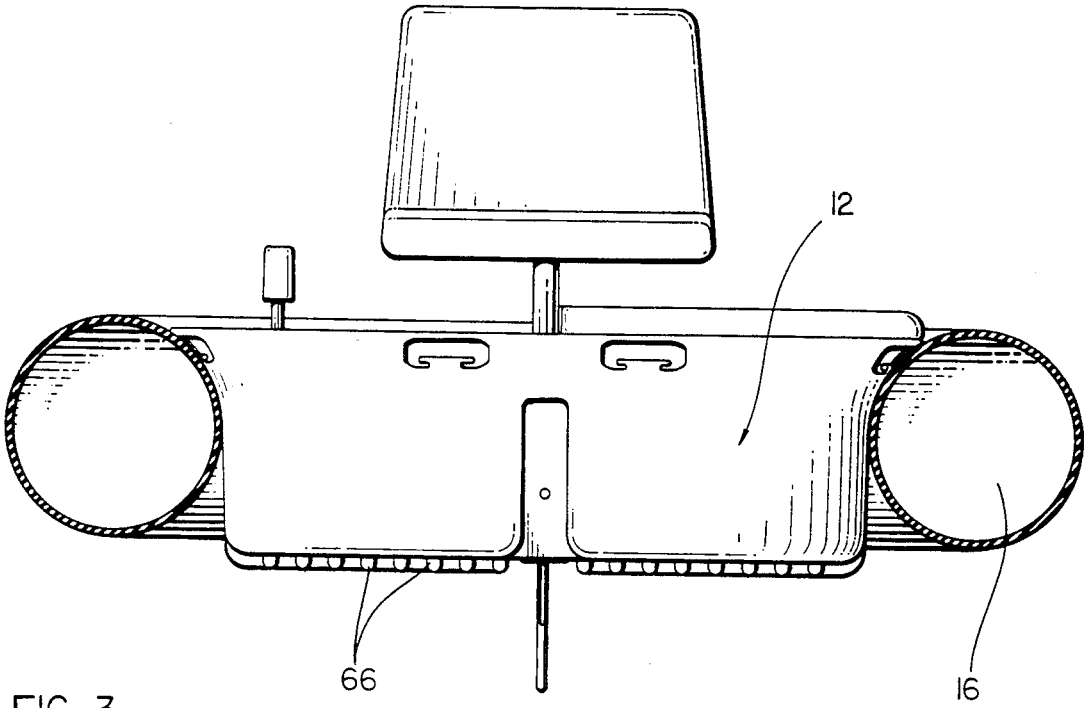
FIG. 3 shows a partial front view of the present invention.

The boat 10 is designed to lower the bow module 12 and raise the stern module 14 in order to correct the weight distribution due to the operator's weight on the stern module 14. The bow module 12 includes a detachable keel 64, as well as a permanent series of keels 66, shown in FIG. 3, which correct weight distribution, correct for drift, add strength to the deck, and lessen buoyancy to trim the fore-and-aft horizontal plane.

Figure 5:
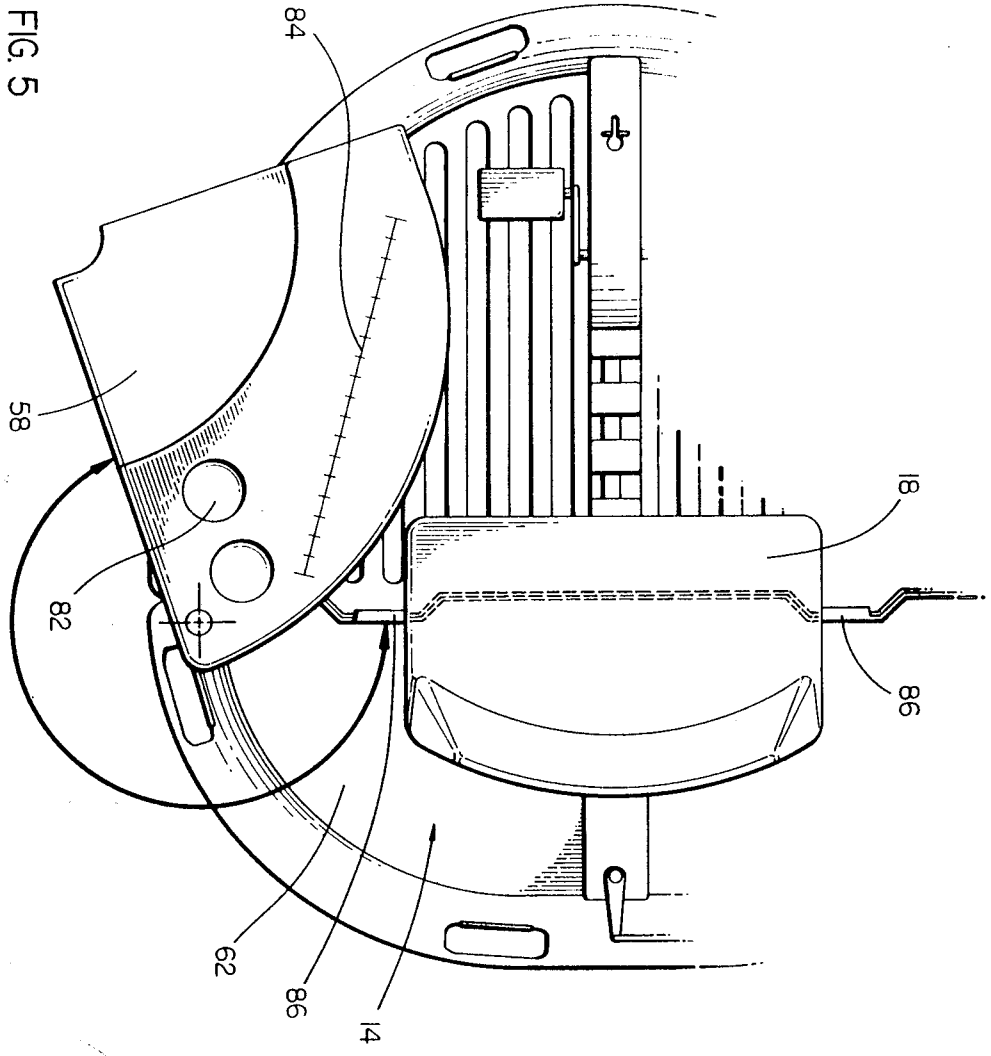
FIG. 5 shows a top view of a section of the present invention.

As shown in FIG. 5, the stern module 14 includes two deck plates 58 along the top surface of the stern module 14. These deck plates 58 are designed to swivel clear of the seat 18 and around to the forward side of the operator to serve as trays and to render access to the storage space 62 inside the stern module 14.

Figure 6:
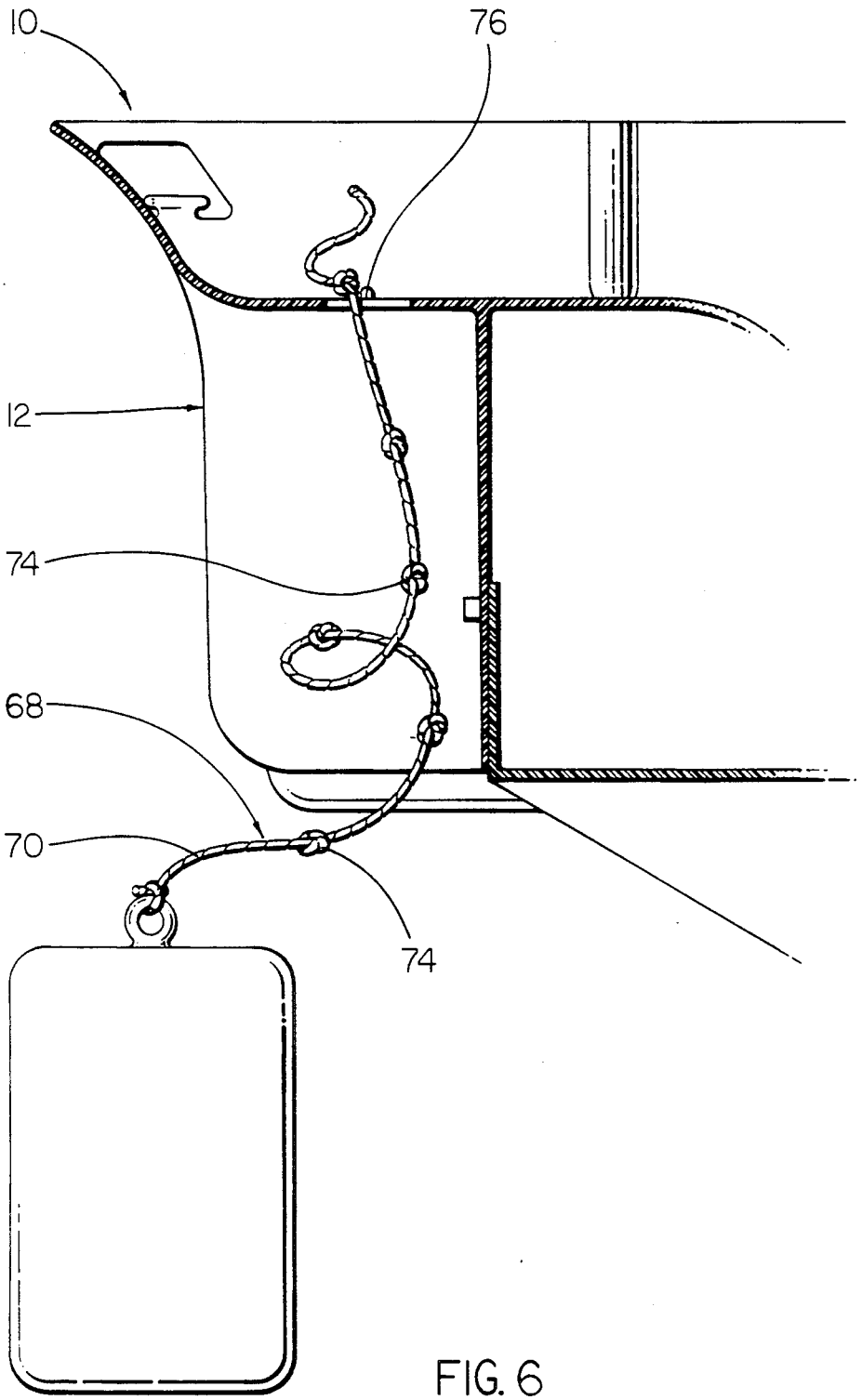
FIG. 6 shows the anchor assembly of the present invention.

As shown in FIG. 6, the boat 10 also includes an anchor assembly 68, which fits compactly in the bow module 12 of the boat 10. Preferably, the anchor assembly is made of blow-molded polypropylene. The anchor rope 70 stows on the deck of the bow module 12 and threads through an anchor rope key hole 76. The rope 70 includes a series of anti-slip knots 74 to facilitate raising and lowering the anchor assembly 68. The rope 70 is accessible to the operator through anchor rope key hole 76, located at the top of the gear box 24, which is shown in FIG. 1.

Figure 7:
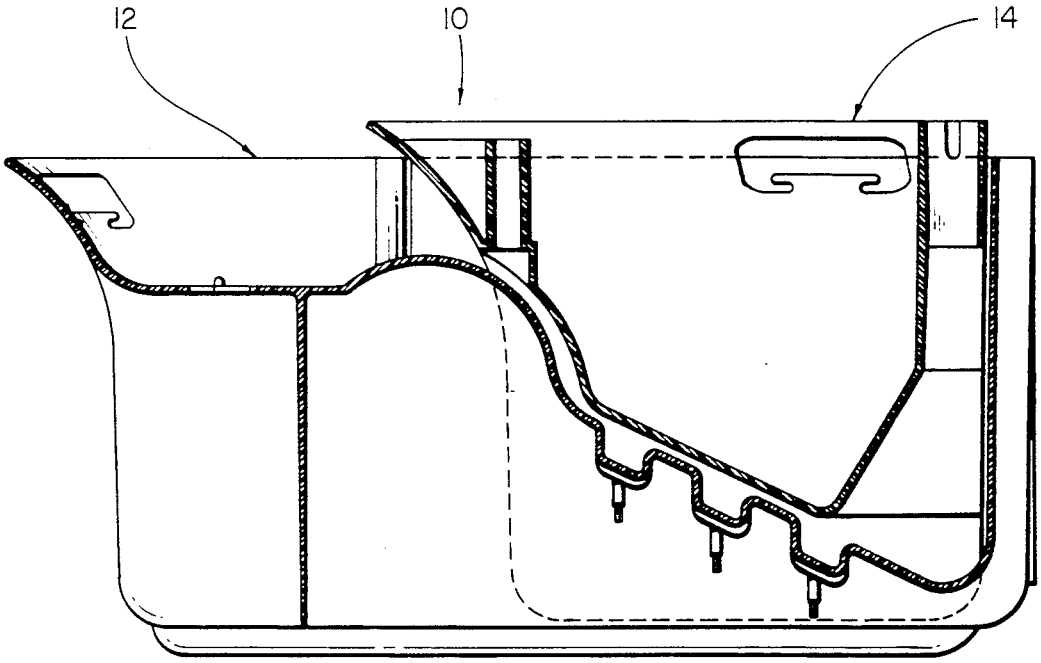
FIG. 7 shows the transport mode of the present invention.

As shown in FIG. 7, the boat 10 is designed for portability such that any and all removable parts will fit inside the storage space 62 in the stern module 14. The modules 12 and 14 are stackable inside each other for compactness. Removable parts such as the tiller 56, the rudder 52, the propeller assembly 22, the detachable keel 64, the seat 18, and the inflatable tube 16 will all fit inside the storage space 62. The stern module 14 will fit inside the bow module 12. The stern module 14 has a recessed slot 60 in the area of the rudder assembly which corresponds to the position of the gear box 24 in the bow module 12. Thus, the modules 12 and 14 can be stacked without any interference from the contours of either module 12 or 14.

The bow module 12 of the boat 10 preferably includes removable rod holders 78 for placing fishing rods. In addition, both modules preferably have a series of handholds 80 for ease in lifting the boat 10. The handholds 80 may include bitts 72 for securing lines and other gear. The deck plates 58 of the stern module 14 may also include accessories. Such accessories are recesses for holding fishing tackle or other gear, depressions 82 to hold drinks, and a modular ruler 84 to aid in measuring fish.

The seat 18, which is disposed toward the flat surface of the stern module 14, is preferably adjustable for height. The seat 18 should also be of a type which will swivel for ease of operation.

The boat 10 of the present invention is easy to assemble and store. The boat 10 can typically be assembled in less than five minutes, and is even quicker to disassemble. When transporting, the boat is only as big as the bow module 12, which is approximately 2.5′×3′×14″, and the boat 10 weighs less than fifty pounds. No individual part of the boat 10 weighs over seventeen pounds.

To assemble, the stern module 14 is connected to the bow module 12 with screws and wing nuts. For additional stability and support, hook latches 86, as shown in FIG. 5, may be used for ease in assembly. The inflatable tube 16 should be placed around the connected modules 12 and 14 and inflated with an air pump. At this point, the detachable parts can be attached to the boat 10. For example, the rudder 52 can be mounted, along with the tiller 56. The anchor assembly 68 and the seat 18 can also be attached. The detachable keel 64, if needed, should be attached along the bottom of the bow module 12. The lower portion 36 of the propeller assembly 22 can be inserted into the shaft cavity 40 and secured by inserting a locking snap-pin into the corresponding through hole.

When assembled, the boat 10 is extremely functional. The boat 10 draws only about an inch of water and can hold a relatively large amount of weight. Thus, the present invention can be used in extremely shallow waters. All parts of the boat 10 are made of incorrodible materials, hence the boat 10 requires little or no maintenance and has a long life.

The boat 10 requires no gas or oil, thus reducing the possibility of a fire. Also, the boat 10 is largely made of plastic and rubber materials, reducing the probability of lightening striking the boat 10. In addition, even if the inflatable tube 16 surrounding the boat 10 is punctured or otherwise deflated, the boat 10 can still be safely pedalled to shore.

The present invention can be easily transported in a conventional automobile trunk, making it very easy to transport to lakes, rivers, and other bodies of water accessible by car. No launching area is necessary as the boat 10 can be launched directly from the shore. The present invention is easy enough to operate and assemble that nearly anyone, man, woman or child, can use the boat 10.

The present invention can be used for recreation, but it is specially designed for fishermen to operate. Additionally, the boat 10 may be used as a rescue vehicle in flood conditions, on broken lake ice and in other emergency conditions. In use as a fishing vehicle, because the boat 10 only draws about an inch of water, the boat 10 can be operated in extremely shallow waters where many fish inhabit. The propeller assembly 22 allows for quiet operation so that the boat 10 can be propelled forward or backward without scaring fish with noisy motors. The boat 10 is also designed to allow fishermen to have nearly full use of their hands while they are simultaneously moving the boat 10 and fishing. The operator's hands are needed only for operating the tiller 56 for correcting the course of the boat 10, while the operator's feet are used for propelling the boat 10. The bow module 12 has approximately 1300 square inches of foot space. This area will allow a fisherman or other operator to stand, which will aid in lessening the fatigue factor of the operator.

The present invention may also include other features. Belts or other drive mechanisms may be used for propelling the boat 10. The inventor may also include a mount for a trolling motor. A canopy may also be included to shade the operator and the boat 10. If a canopy is not used, the boat 10 may include umbrella holders to support umbrellas to shade the operator. Also, the boat 10 may have a fish drop through the deck of the bow or stern module 12 or 14 to keep fish once they are caught. In addition, the boat 10 may be scaled down to approximately one half its standard size for use in swimming pools or the like.

While this invention has been described in detail with particular reference to the preferred embodiment thereof, it will be understood that variations and modifications can be effected within the spirit and scope of the invention as previously described and as defined in the claims.

What is claimed is:

1. A portable boat assembly for use by an operator comprising:

(a) a bow module having a bottom, a rounded side with an upper portion, a flat side, and an upwardly and outwardly curved flange extending along the upper portion of said bow module rounded side;

(b) a stern module having a bottom, a rounded side with an upper portion, a flat side, an upwardly and outwardly curved flange extending along the upper portion of said stern module rounded side, and a forward portion;

(c) said bow module and said stern module being interlocked to form a float platform;

(d) an inflatable tube, said inflatable tube surrounding said interlocked bow module and stern module and being seated outwardly of and against each upwardly and outwardly curved flange of said bow module and said stern module for holding said bow module and said stern module together and for providing buoyancy to said float platform;

(e) means for powering said portable boat assembly, said means for powering having a gearbox located within said bow module, said gear box having a propeller shaft cavity extending through said bow module bottom, a propeller shaft with a propeller fixed thereon journaled within said cavity, and pedals;

(f) means for steering said portable boat assembly, said means for steering having a rudder, a recessed slot formed in said stern module bottom, said rudder being partially located within said recessed slot, and a tiller, said tiller being located in said forward portion of said stern module;

(g) and a seat, said seat being located in said forward portion of said stern module, said tiller being adjacent said seat.

2. The portable boat assembly of claim 1, wherein said powering means further comprises:

a) a gear assembly disposed within said gearbox such that movement of said pedals and said gear assembly is converted into movement of said propeller shaft and said propeller for propelling said portable boat assembly through water;

(b) and keel means for controlling the drift of said portable boat assembly.

3. A portable boat assembly as recited in claim 2, wherein said gear assembly includes a large bevel gear rotatable by said pedals and a small bevel gear fixed to said propeller shaft.

4. A portable boat assembly as recited in claim 1, wherein said stern module includes a storage space.

5. A portable boat assembly as recited in claim 4, wherein said stern module includes deck plates for convering said storage space, said deck plates being pivotable about the operator so as to function as trays.

6. A portable boat assembly as recited in claim 1, wherein said means for steering said portable boat assembly further comprises a rudder linkage, said rudder linkage connecting said rudder and said tiller, and said rudder linkage being disposed along a portion of the upper portion of said rounded side of said stern module.

7. A portable boat assembly as recited in claim 1, wherein said bow module includes a permanent series of keels integral with said bow module.

8. A portable boat assembly as recited in claim 1, wherein said stern module is stackable inside said bow module for portability when transporting said portable boat assembly.

9. A portable boat assembly as recited in claim 1, further comprising an anchor assembly located within said bow module.

10. A portable boat assembly as recited in claim 9 wherein said anchor assembly comprises an anchor, an anchor rope attached to said anchor, and an anchor rope keyhole located in said bow module, said anchor rope having a series of anti-slip knots, said anchor rope extending through said anchor rope keyhole, said anchor being raised and lowered by moving said anchor rope through said anchor rope keyhole, and said anchor rope being secured with said anti-slip knots.

* * * * *